US007448926B2

(12) United States Patent
Paterson et al.

(10) Patent No.: US 7,448,926 B2
(45) Date of Patent: Nov. 11, 2008

(54) IMPELLER DRIVE FOR A WATER JET PROPULSION UNIT

(75) Inventors: Paul Mark Paterson, Gore (NZ); Barry John Davies, Tuatapere (NZ)

(73) Assignee: Propeller Jet Limited, Southland (NZ)

( * ) Notice: Subject to any disclaimer, the term of this patent is extended or adjusted under 35 U.S.C. 154(b) by 0 days.

(21) Appl. No.: 10/564,140

(22) PCT Filed: Jul. 13, 2004

(86) PCT No.: PCT/NZ2004/000148

§ 371 (c)(1),
(2), (4) Date: Jan. 10, 2006

(87) PCT Pub. No.: WO2005/005248

PCT Pub. Date: Jan. 20, 2005

(65) Prior Publication Data

US 2007/0009355 A1 Jan. 11, 2007

(30) Foreign Application Priority Data

Jun. 24, 2003 (NZ) ..... 526666
Dec. 1, 2003 (NZ) ..... 529891

(51) Int. Cl.
*B63H 11/00* (2006.01)

(52) U.S. Cl. ..... 440/38; 440/79

(58) Field of Classification Search ..... 440/38, 440/75, 79, 80, 81; 415/208.2
See application file for complete search history.

(56) References Cited

U.S. PATENT DOCUMENTS 3,153,907 A * 10/1964 Griffith ..... 60/39.15
3,269,111 A 8/1966 Brill
3,561,392 A 2/1971 Baez
3,601,989 A * 8/1971 Austin ..... 440/75
3,993,015 A * 11/1976 Klepacz et al. ..... 440/41
5,480,330 A * 1/1996 Brown ..... 440/38
5,618,213 A * 4/1997 Nanami ..... 440/38
5,634,831 A * 6/1997 Davies et al. ..... 440/47
6,193,569 B1 2/2001 Davies et al.
6,273,768 B1 * 8/2001 Blanchard ..... 440/38

FOREIGN PATENT DOCUMENTS

DE 3831136 A1 3/1980
DE 3942672 A1 7/1991
WO WO 94/08845 4/1994
WO WO 98/47760 10/1998
WO WO 98/57848 12/1998
WO WO 00/38980 7/2000

OTHER PUBLICATIONS

European Patent Office, Application No./Patent No. 04748843.2-2422/ PCT/NZ2004/000148, Communication: Supplementary Search Report; Annex to the European Search Report on European Patent Application No. 04 74 8843.

* cited by examiner

*Primary Examiner*—Lars A Olson
(74) *Attorney, Agent, or Firm*—McCormick, Paulding & Huber LLP

(57) ABSTRACT

A water propulsion unit having an intake housing, a pump housing and an outlet with two spaced apart counter rotating impellers being located in the pump housing. The impeller blades on one impeller have an opposite pitch to the blades of the second impeller. The impellers are configured so that one of the impellers will impart less energy to the water as it passes the blades of the impeller than the second impeller.

21 Claims, 4 Drawing Sheets

IMPELLER DRIVE FOR A WATER JET PROPULSION UNIT

FIELD OF THE INVENTION

This invention generally relates to water jet propulsion apparatus for propelling boats and other watercraft and also to stationary pumps and hydro electric generation.

BACKGROUND OF THE INVENTION

Water jet propulsion apparatus operate by utilizing the reaction forces resulting from propelling a mass in one direction thus creating an equal and opposite force in the other direction.

A high-pressure jet produces its thrust substantially in the nozzle section at the rear of the device. The impellers that produce the thrust are fine in pitch so that they are able to develop a pressure head, which in turn creates a large change in velocity as the water is forced through a rapidly reducing outlet. The water speed forward of the nozzle section in a water jet operating above the water line, is not the same as the water speed of the boat or craft. The water speed in the intake and impeller section is below boat speed, and so the change in velocity is calculated from the net change in velocity from the intake to the outlet of the nozzle, the greater change taking place in the latter.

Another form of water jet propulsion apparatus consists in a unit which delivers a considerable mass of water through an outlet nozzle but at a comparatively low pressure. Such devices are commonly known as a low pressure, high mass unit.

Water jet propulsion systems have attributes specific to the characteristic relating to the design of the unit. It is known that high pressure jet propulsion systems are particularly effective in shallow water operation. The shortcomings of a high pressure jet propulsion system however, relate generally to its slow to mid speed operation. A water jet requires high pressure in order to create a velocity change in the nozzle section sufficient to produce usable thrust. To achieve this, the known systems employ a fine pitched, pressure-inducing impeller or impellers, often followed by one or more stator sections, and then a reducing nozzle. The fine pitched impellers range from about 11-20 degrees, and thus have a reduced advance coefficient (ratio of boat speed to impeller tip speed). At slow impeller revolutions, they develop relatively low thrust.

A water jet propulsion system has a markedly reduced water speed forward of the nozzle section. Water diffuses into an intake section in front of the upstream Impeller, and as it does so, it slows down. This slowing down of the water as it passes through the body of the pump reduces losses through friction. The stators (water straightening vanes, placed downstream from the impellers) also represent a potential for unacceptable frictional losses if the water speed upstream from them is raised too high. The use of low advance coefficient impellers keeps the velocity low, but enables very high pressure to be produced in the nozzle section. This is where the greatest change in velocity takes place resulting in usable thrust. This locks a high-pressure jet system into having a configuration where a relatively low mass of water is accelerated to very high velocities in a nozzle section located downstream from all of these structures.

For a user who requires both good boat speed, but also slow speed control at low engine revolutions, the high pressure jet has limitations, as it expels a relatively low mass of water at low plume velocity. Where low impeller speeds and high propulsor thrusts are required, the high-speed jet is not a good substitute for a propeller system.

Considerable development has therefore been directed towards improving the efficiency of water jet propulsion units and in particular to provide a propulsion unit that can act as an effective high pressure low mass device and a low pressure high mass device.

PRIOR ART

A high pressure jet propulsion system is disclosed in U.S. Pat. No. 3,044,260 (Hamilton). The Hamilton system is characterised by impellers that have a low advance coefficient. A greatly reducing nozzle cross-sectional area results in a very large change in water velocity, and thus thrust is produced.

Other forms of high pressure pumps have been described in U.S. Pat. No. 3,269,111 (Brill) and U.S. Pat. No. 3,561,392 (Baez).

A variety of adjustable discharge nozzles have been described for instance in U.S. Pat. No. 5,658,176, (Jordan) which teaches a nozzle pressure control device designed to optimise the pressure in a high-pressure pump. Jordan does not define the conditions necessary for optimal efficiency in a low-pressure pump, it refers to the "pumping means forcibly delivers the water through the nozzle thereby propelling the craft . . . "(Column 1 lines 14-17). This is clearly referring to the thrust being generated in the nozzle section. The inclusion of a stator section also precludes this device from being a low-pressure pump.

U.S. Pat. No. 6,293,836 (Blanchard) describes an adjustable nozzle for a high-pressure pump. At column 1 lines 27-29 there is a reference to pressure being developed in the nozzle, where it is stated: "A smaller opening is also desirable for low-speed manoeuvering, as it would result in higher velocity of the exiting water flow at low engine rpm."

There has been a previous attempt to overcome the limitations of high pressure water jets. U.S. Pat. No. 5,634,832 (Davies) and U.S. Pat. No. 6,193,569 (Davies) describe an above the water line jet operating at low pressures. Unlike traditional pressure jets, where the thrust is developed in the nozzle section, a low-pressure jet produces a change in velocity predominantly across its impeller blades. By utilising the very low intake water velocities forward of the impellers, large gains in efficiency can be achieved. In order to be at its most efficient, the pump backpressures must be kept as low as possible, to allow the accelerated water minimal impedance as it leaves the downstream impeller. Such a low pressure device therefore does not use a constricted outlet for the nozzle which is in contradistinction to the manner in which the nozzle section of a high pressure jet operates.

The counter rotating impellers also provide straight or linear flow at the outlet, thus removing the need for stators. This also means that once the water has been accelerated to its terminal velocity, there should be no structures present that will slow the velocity of the water. One arrangement of an underwater structure is described in U.S. Pat. No. 5,846,103 (Varney et al) which teaches a arrangement of a pump jet that is suspended under the boat, so that the intake is subject to boat speed water velocities.

The impellers for a low pressure jet ideally should be designed to have a relatively high advance coefficient and this requires course-pitched impellers. Likewise, the body of the pump should not create drag or friction as a result of it being exposed to the fast moving water under the boat.

The above prior art and known technology in this field teach that in order for a low pressure/high mass jet to operate efficiently, a vital parameter must be taken into account as impeller revolutions increase, and the change in velocity across the blades of the impellers goes up.

In a low pressure, high mass pump, air being drawn back into the pump by the drop in pressures developed over the impellers and in the intake, induces ventilation, similar to a propeller operating near the surface of the water. To combat this an adjustable anti-ventilation device can be placed in the exhaust outlet to accommodate the different priming requirements across a wide range of impeller revolutions per minute. This device is not always necessary, as the exhaust outlet size may be fixed at a target setting, however there are some situations where the use of such a device will aid the operation of the jet. At slow internal pump velocities, the exhaust outlet opening would be at its largest, and would be characterised by a very low plume velocity. If the outlet was to remain under the water during operation, then the outlet can be larger again. As the water velocity increases through the pump, the exhaust outlet must reduce in area, to control ventilation, and enable the craft to be driven onto the plane, and up to very high speeds.

All known water jet propulsion units including mixed flow pumps, centrifugal, axial flow and low pressure counter-rotating pumps are characterised by having 'closed' impeller blades, that is the leading edge of one blade will overlap the trailing edge of the next blade on that impeller. This configuration is regarded as being required to enable the pump to be self priming, that is because the propulsion unit is in effect a pump operating above the water level, it must be able to create a drop in pressure upstream of the impellers that will force water through the pump intake and onto the impeller blades of the upstream impeller. This self priming feature must remain throughout the operation of the pump to ensure adequate delivery of water through the pump. As the boat moves through the water, the forward movement will also assist in keeping the pump primed because of the ram effect on the water entering through the intake.

Known water propulsion systems utilising two counter rotating impellers have impellers which are essentially identical, except that the blades of one impeller will be the opposite pitch to the blades of the other impeller. The effect of this is that each impeller will essentially impart the same amount of energy to the water.

It has also been suggested in an effort to improve efficiency to make the downstream impeller of a counter rotating twin impeller pump do more work that the upstream impeller so the impellers will be balanced in their operation.

It is considered by the inventors that the use of two counter rotating impellers each of which has overlapping blades will create a drop in efficiency and therefore performance and it has been surprisingly found that by forming one impeller, either the upstream or downstream impeller so it is less efficient than the other will create an Increase in efficiency.

In addition it is also considered that the two impellers should be configured so the downstream impeller cannot create suction against the upstream impeller. It is, of course, necessary that the upstream impeller be configured so it can create a drop in pressure on the upstream side of the impeller to enable the unit to be self priming and generate a change in velocity across the impeller blades, such that thrust is produced.

A yet still further requirement is that the two impellers work in a manner that the possibility of cavitation, that is when air enters the pump particularly through the outlet of the pump is minimised.

A significant factor therefore in the efficiency of the pump is to control the relative suction that can exist in the zone between the upstream and the downstream impellers. If the downstream impeller has to overcome suction imparted by the upstream impeller, then a proportion of the available energy is utilised in overcoming the suction instead of being utilised to generate propulsion.

OBJECT OF THE INVENTION

It is an object of this invention to provide an improved low pressure high mass pump which will be efficient at various boat speeds and in particular which at higher boat speeds will provide the desired efficiency.

SUMMARY OF THE INVENTION

In one form the invention a water propulsion unit comprising an intake housing, a pump housing, an outlet housing, an upstream impeller and a downstream impeller, said upstream and downstream impellers being spaced apart and located within the pump housing between the intake housing and the outlet housing, each impeller including a series of impeller blades extending radially from a central boss, the blades of the upstream impeller being of opposite pitch to the blades of the downstream impeller;

wherein said impellers are mounted on and, in use, driven by shafts so as to be co-axial with each other, within the pump housing;

wherein the impellers are configured such that in use one of the impellers will impart less energy to the water passing that impeller than the remaining impeller;

and the upstream impeller in use will create a drop in pressure upstream of said upstream impeller and impart a rapid change in velocity to the water as it passes over the blades.

Preferably the downstream impeller is adapted to remove a substantial amount of the radial energy in the water as it passes the downstream impeller, In another form the invention may be said to comprise a vessel propulsion unit including an upstream impeller and a downstream impeller, a pump housing, a water inlet to communicate with the upstream impeller and an outlet to communicate with the downstream impeller, the said impellers being spaced apart and having concentric axes and being adapted to be rotated within the pump housing in opposite directions, and wherein the blades of one impeller are of opposite pitch to the blades of the second impeller, characterised in that one of the impellers is arranged to impart less energy to the water than the other impeller.

Preferably the unit is configured so the suction generated by the downstream impeller in the area between the upstream impeller and the downstream impeller is controlled.

Preferably the downstream impeller imparts greater energy to the water than the upstream impeller.

Preferably one of the impellers is formed with less blades than the other impeller.

Preferably the upstream impeller has less blades than the downstream impeller.

Preferably one of the impellers has blades of a closed configuration and the second impeller has blades of an open configuration.

Preferably the blades of the upstream and the downstream impellers are of open configuration.

Preferably a clearance is left between the tips of the blades of one of the impellers and the inner wall of the pump housing.

Preferably the rotational speed of the downstream impeller is less that the rotational speed of the upstream impeller.

Preferably both impellers are mounted on concentric counter-rotating shafts.

Preferably the two impellers are driven from a single engine through reduction gearing to provide the desired ratio of rotational speeds between the upstream and downstream impellers.

Preferably the ratio of rotational speeds between the downstream and the upstream impellers is fixed.

Preferably the ratio of rotational speeds between the downstream and the upstream impellers can be altered.

Preferably each impeller is driven by a separate engine.

Preferably the intake housing is bulged outwardly upstream of the upstream impeller.

Preferably means are provided to vary the cross sectional area of the interior of the pump housing between the upstream and the downstream impellers.

Preferably means are provided to vary the cross sectional diameter of the outlet.

Preferably the cross sectional area of the outlet can be varied to an optimum size to allow the maximum amount of water to exit the unit while also controlling ventilation.

Preferably the upstream and the downstream impellers are both of axial flow configuration.

Preferably the upstream impeller is of mixed flow configuration and the downstream impeller is of axial flow configuration.

DETAILED DESCRIPTION OF THE PREFERRED EMBODIMENTS

Figure 1:
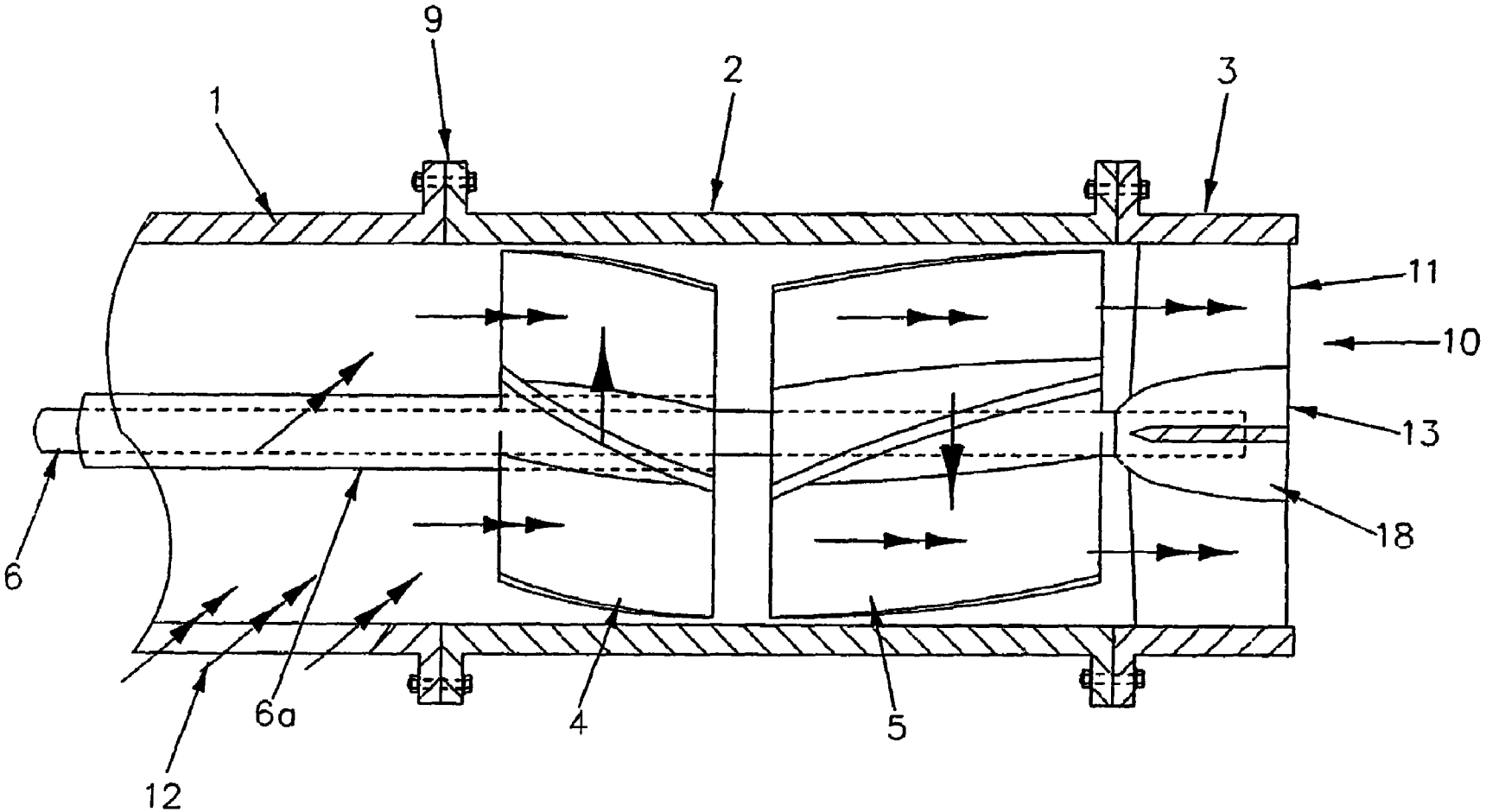
FIG. 1 is a side elevation cut away view of part of one form of a low pressure/high mass water jet pump according to this invention.

Prior to the present invention, the construction of either a high pressure low mass unit, or a low pressure high mass unit comprised the utilization of two (or more) impellers mounted on concentric shafts and rotated in opposite directions. Both impellers were of essentially the same construction apart from the necessity for the blades of one impeller to be of an opposite pitch to the blades of the other impeller. Both impellers in the prior art units were arranged to impart a similar amount of energy to the water, typically by driving both impellers at the same revolutions per minute.

The theory of twin impellers is that the upstream impeller will impart both a radial and an axial energy to the water which is delivered to the downstream impeller. Because the downstream impeller is rotating in the opposite direction, while additional axial energy is imparted to the water, the radial energy in the water passing the blades of the downstream impeller is also largely converted to axial energy.

It has been found that if both impellers are of the same or similar construction, but with opposite pitches and rotate at equal speeds, this can create unwanted drag on the water passing the blades of the impellers with inadequate results. To enable efficient operation it is necessary to balance the amount of work being done by each impeller.

The improvement in the technology of water propulsion units resulting from this invention is to make one of the impeller units to be less efficient that the other without impeding the flow of water or introducing unwanted frictional losses.

A preferred feature of the present invention is to arrange the upstream impeller to do more work than the downstream impeller, such as by reducing the revolutions of the downstream impeller, then efficiency gains are possible. However as will be seen from the following description, other configurations are also possible.

In one form of the invention, each impeller may be driven through appropriate gearing by a separate engine (not shown in the drawings). In another form, both impellers are driven through appropriate gearing by the same engine.

In one preferred form, the gearing is arranged so that the relative speeds of the two impellers are fixed in a manner that the downstream impeller will always rotate at a different speed than the upstream impeller.

In another preferred form of the invention, the gearing is arranged to be variable so that the rotational speed of the downstream impeller relative to the rotational speed of the upstream impeller can be adjusted, either while the unit is in operation, or when the unit has been stopped. Suitable forms of adjustable gearing to achieve this requirement are known in the art and form no part of the present invention.

It will also be understood that while in a highly preferred form, the impellers are mounted on concentric, counter rotating shafts, in a modification the shafts can be separate with appropriate changes to the construction to enable the two impellers to be axially aligned.

In accordance with the present invention it is proposed to balance the work done by the two impellers and to that effect the delivery rate of the upstream impeller must be increased, or conversely the ability of the upstream impeller to hold back pressure must be reduced so the downstream impeller can 'suck' more water. However it is important that the amount of suction between the two impellers is carefully graduated in order to obtain the maximum efficiency.

It has also been surprisingly found that by varying the relative speed or rotation of the two impellers a significant increase in the efficiency of the unit can be secured. In particular it was found that when the rotational speed of the upstream impeller was increased and the rotational speed of the downstream impeller remained the same, the efficiency of the unit increased while still maintaining linear flow at the outlet. Consequently the characteristics of the unit can be considerably changed by adjusting the rotational speed of the two impellers, particularly so that the rotational speed of the downstream impeller is less than the rotational speed of the upstream impeller. This observed effect occurs whether or not the two impellers are of similar construction.

Figure 2:
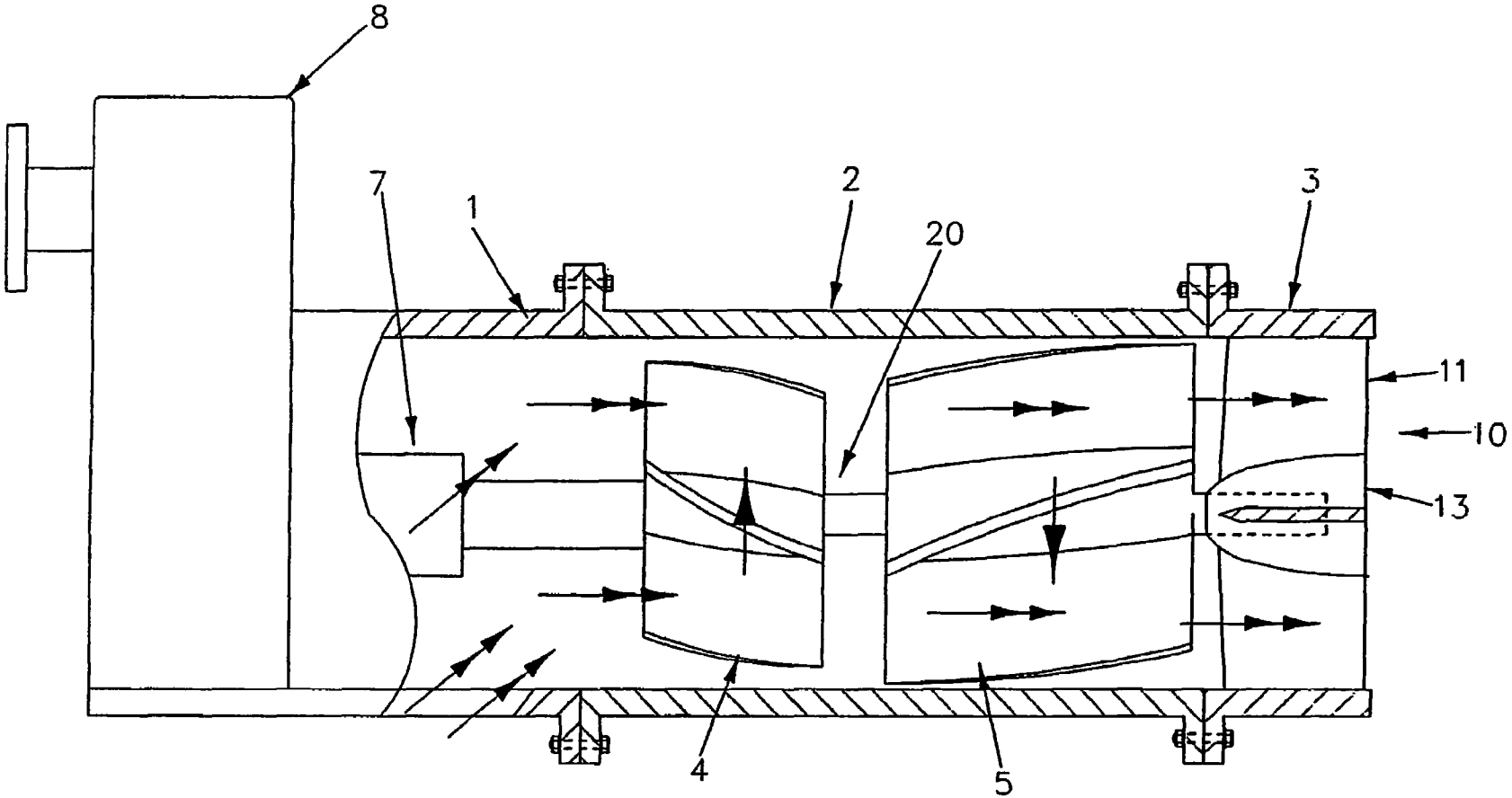
FIG. 2 is a side elevation cut away view of another form of a low pressure/high mass water Jet pump according to this invention.

In the form of the invention illustrated in FIGS. 1 and 2, the unit has an intake housing 1, a pump housing 2 and an outlet housing 3. The impellers 4 and 5 are locked onto counter rotating shafts 6 and 6*a* which are supported by a shaft support 7. The shafts 6 and 6*a* are driven from a gearbox 8. The pump housing may also include a suitable transom seal one form of which is illustrated at 9. The impellers 4 and 5 are locked to the shafts by suitable keys (not shown in the drawings) as will be known in the art.

The shaft 6*a* is also supported at the rear of the unit inside the outlet housing 3 by the structure 10 which may be located by thin hydrodynamic vanes 11. These vanes should be little in number and streamlined, so that they do not unnecessarily induce drag or friction in the pump housing 3 which in this embodiment is depicted as tubular, and parallel.

The shafts 6 and 6*a* are suitably supported by bearings (not shown in the drawings) and protected by seals (not shown in the drawings) in a manner as will be apparent to those skilled in the art.

As illustrated in FIG. 1 the blades of the upstream impeller 4 are of the same construction and number as the blades of the downstream impeller 5 except they are of opposite pitch.

The counter-rotation of the downstream impeller 5 removes the rotational energy imparted to the water by the upstream impeller 4, resulting in linear flow in the exhaust outlet 3. This removes the need for straightening vanes (stators) commonly found in other jet propulsion units.

As the water passes through the intake in the direction of the arrow 12, it passes through the upstream impeller 4, where it is spun and driven outwards towards the inner walls of the pump housing. As the water progresses to the rear of the upstream impeller 4 it will be annular in appearance and spiraling rearwards along the pump housing walls towards the downstream impeller. The downstream impeller will tend to straighten the water by removing the radial energy and at the time the water exits the rear of the downstream impeller 5, it is essentially axial in flow, and annular in shape.

As illustrated in this embodiment, the pump may also include a ventilation device 13. In one preferred form the outlet 3 is of constant internal dimensions and a smooth coned plug 18 is located in the outlet. The diameter of the plug increases towards the outlet 3. The desired cross-sectional area of the outlet 3 will vary according to the rotational velocities of the water over the impellers, and will preferably fall between about 0.55 and 0 as a ratio of the area of the upstream impeller blades and the outlet. If necessary, the diameter of the plug 18 can be adjusted to give maximum thrust at the desired outlet water velocity. The cross sectional area of the interior of the outlet 3 formed by the combination of the interior wall of the outlet 3 and the plug 18 is such that it will prevent or substantially prevent air from reentering the pump and thus cause ventilation. In addition the cross sectional area of the outlet 3 will be such that back pressure will be maintained against the downstream impeller as low as possible while presenting minimal impedance to the water as it exits the outlet.

As illustrated in FIG. 2, the upstream impeller 4 has the same number of blades as the downstream impeller, but the blades of the upstream impeller are of smaller diameter than the blades of the downstream impeller 5 so leave a significant clearance between the tips of the blades and the interior wall of the pump housing. This configuration will assist to allow the suction of the downstream impeller to be relieved.

Figure 3:
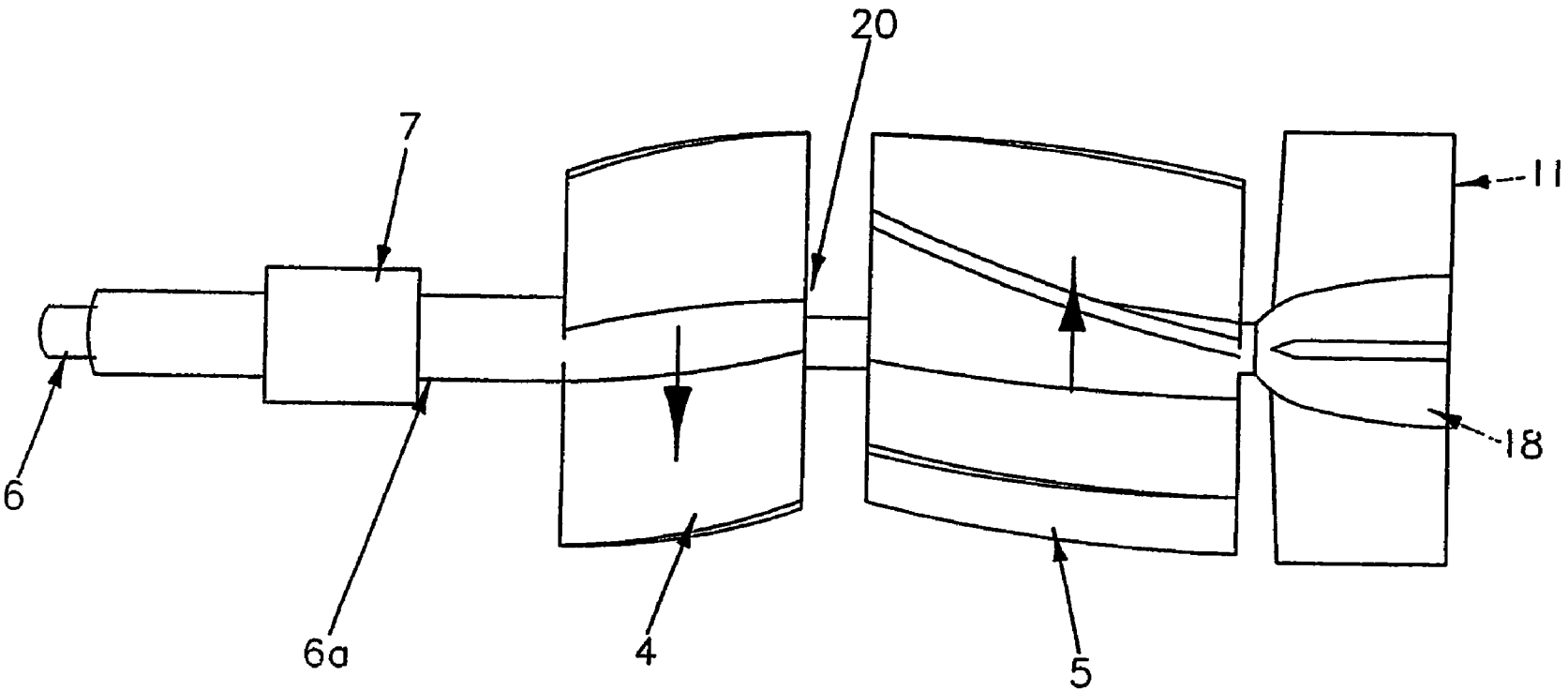
FIG. 3 is a side elevation view of two impellers and their associated parts of another form of the invention.

As illustrated in FIG. 3 where like parts have the same reference numerals, the upstream impeller 4 is the same diameter and construction, but of opposite pitch, as the downstream impeller 2*b* but in the form illustrated, the impeller has two blades only in contradistinction to the downstream impeller 5 which has five blades.

Figure 4:
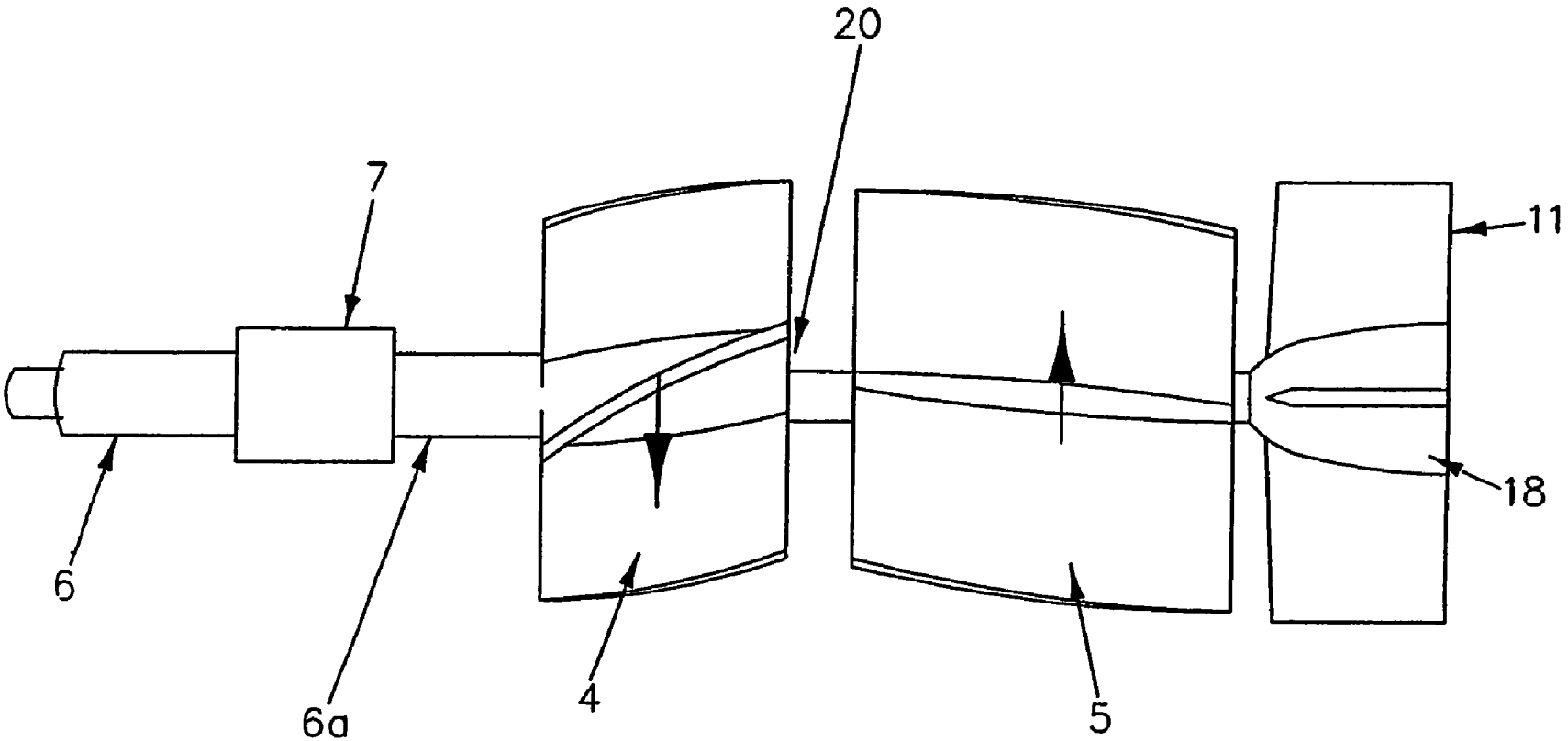
FIG. 4 is a side elevation of the driving shafts, the upstream and downstream impellers and support structure of another form of the invention.

In a yet further construction as illustrated in FIG. 4, the downstream impeller 5 is provided with open blades while the upstream impeller 4 is provided with closed blades so that the downstream impeller will act more like a propeller. It is to be understood that it is also contemplated that the downstream impeller can be formed with either less blades than the upstream impeller or be open in design.

In another form the gearbox 8 is arranged so that the rotational speed of one impeller is different to the rotational speed of the other impeller so as to provide means of adjusting the relative amount of work done by each impeller. In yet another form, not shown in the drawings, the rotational power for each impeller is provided by a separate engine to thereby enable the relative speed of the two impellers to be readily adjusted to suit the particular circumstances and requirements.

The counter-rotation of the impellers may also be achieved by driving the impellers through a gearbox placed behind the downstream impeller, between the two impellers, in the intake section, or any combination between these positions.

Methods for keeping particles or marine growth away from the moving parts may also be employed. These may include flexible covers, or sealed compartments as will be known in the art. and are not shown in the drawings and form no part of this invention.

The unit may also incorporate suitable steering vanes or the like positioned so that water exiting the outlet will flow through the vanes which can have their angle of attack altered to thereby provide steering. Means can also be incorporated to allow the flow of water exiting the outlet to be reversed, thereby enabling the boat to be reversed.

In yet another form, the aerofoil shape of the blades of one impeller can be changed to alter the efficiency of the impeller.

The main purpose of the upstream impeller according to this invention is to induce a swirl into the water, and change the velocity of the water, as it passes the impeller and to minimise drag associated with the upstream impeller. These modifications, such as the reduced diameter and the changes to the aerofoil shape of the blades of the impeller, or other changes as herein discussed, reduce the efficiency of the impeller allowing more water to pass without unduly creating drag. It is considered that without these modifications, the upstream impeller acts as a form of a dam with deleterious results on the performance of the unit.

One method of providing an independent adjustment of the relative speeds of rotation of the impellers it to utilise a separate engine to drive each impeller. It has been found in certain circumstances that at higher boat speeds, very little rotational speed needs to be imparted to the downstream impeller, while at lower boat speeds, it can be advantageous to impart more rotational speed to the downstream impeller. The relative speeds of the two impellers can also be fixed such as when both impellers are driven by the same engine and in such a case the difference in the rotational speeds can be obtained by suitable gearing. Such gearing can be of a fixed ratio or can be made variable by methods as are known in the art.

It is to be understood that the basis of the invention lies in the ability to control suction that may occur in the area 20 that may exist between the impellers 4 and 5.

Another significant advantage provided by the present invention lies in the fact that because the unit operates essentially as a low pressure high mass unit, water issuing from the outlet of the jet unit will be traveling at a speed which is not much greater than boat speed. This will significantly reduce the risk of erosion resulting from the high speed plume of water generated by high pressure low mass devices. In addition, because water issues from the outlet at a comparatively low pressure, low speed maneuverability of the unit is enhanced. Further because one impeller is not working against the other (they are in balance) greater thrust and fuel savings are achieved.

It is understood that those skilled in the art could make various changes within the structures present inside the pump to carry out a similar function. The particular representations of the invention as presented in the drawings is not intended to be restrictive, or limiting, and it is the intention that the invention will include all configurations falling within the concept of the invention.

The invention claimed is:

1. A water propulsion unit including an upstream impeller and a downstream impeller, a pump housing, a water inlet to communicate with the upstream impeller; and an outlet to directly communicate with the downstream impeller, the said impellers being mounted on and, in use, driven by shafts so as to be co-axial with each other, within the pump housing; said impellers are spaced apart and are adapted to be rotated within the pump housing in opposite directions, and wherein each impeller includes a series of impeller blades extending radially from a central boss, and the blades of the upstream are of opposite pitch to the blades of the downstream impeller;

characterized in that, the water jet propulsion unit is a low pressure high mass device; one of the impellers is arranged to impart less energy to the water than the other impeller;

wherein means are provided to vary the cross sectional area of the interior of the pump housing between the upstream and the downstream impellers; and wherein the cross-sectional area of the outlet is such that in use it presents minimal impedance to the flow of water therethrough.

2. The water propulsion unit of claim 1, wherein the downstream impeller is adapted to remove a substantial amount of the radial energy in the water as it passes the downstream impeller.

3. The water propulsion unit of claim 1 wherein it is used as a vessel propulsion unit.

4. The water propulsion unit of claim 1, wherein the unit is configured so the suction generated by the downstream impeller in the area between the upstream impeller and the downstream impeller is controlled.

5. The water propulsion unit of claim 1, wherein the upstream impeller imparts greater energy to the water than the downstream impeller.

6. The water propulsion unit of claim 1, wherein one of the impellers is formed with fewer blades than the other impeller.

7. The water propulsion unit of claim 6, wherein the upstream impeller has fewer blades than the downstream impeller.

8. The water propulsion unit of claim 1, wherein one of the impellers has blades of a closed configuration and the second impeller has blades of an open configuration.

9. The water propulsion unit of claim 1, wherein the blades of the upstream and the downstream impellers are of open configuration.

10. The water propulsion unit of claim 1, wherein a clearance is left between the tips of the blades of one of the impellers and the inner wall of the pump housing.

11. The water propulsion unit of claim 1, wherein the rotational speed of the downstream impeller is less than the rotational speed of the upstream impeller.

12. The water propulsion unit of claim 1, wherein both impellers are mounted on concentric counter-rotating shafts.

13. The water propulsion unit of claim 1, wherein the two impellers are driven from a single engine through reduction gearing to provide a desired ratio of rotational speeds between the upstream and downstream impellers.

14. The water propulsion unit of claim 1, wherein a ratio of rotational speeds between the downstream and upstream impellers is fixed.

15. The water propulsion unit of claim 13, wherein the ratio of rotational speeds between the downstream and upstream impellers can be altered.

16. The water propulsion unit of claim 1, wherein each impeller is driven by a separate engine.

17. The water propulsion unit of claim 1, wherein an intake housing is bulged outwardly upstream of the upstream impeller.

18. The water propulsion unit of claim 1, wherein means are provided to vary the cross sectional diameter of the outlet.

19. The water propulsion unit of claim 1, wherein the cross sectional area of the outlet can be varied to an optimum size to allow the maximum amount of water to exit the unit while also controlling ventilation.

20. The water propulsion unit of claim 1, wherein the upstream and the downstream impellers are both of axial flow configuration.

21. The water propulsion unit of claim 1, wherein the upstream impeller is of mixed flow configuration and the downstream impeller is of axial flow configuration.

* * * * *

UNITED STATES PATENT AND TRADEMARK OFFICE

CERTIFICATE OF CORRECTION

PATENT NO. : 7,448,926 B2
APPLICATION NO. : 10/564140
DATED : November 11, 2008
INVENTOR(S) : Paul Mark Paterson and Barry John Davies It is certified that error appears in the above-identified patent and that said Letters Patent is hereby corrected as shown below:

Column 7, line 1, after “the”, please delete “pump” insert --outlet--.

Signed and Sealed this
Twelfth Day of April, 2011

David J. Kappos

David J. Kappos
*Director of the United States Patent and Trademark Office*